United States Patent [19]

Carlin

[11] Patent Number: 4,763,284

[45] Date of Patent: Aug. 9, 1988

[54] REACTION TIME AND FORCE FEEDBACK SYSTEM

[76] Inventor: John A. Carlin, 1795 S. St. Paul, Denver, Colo. 80210

[21] Appl. No.: 831,979

[22] Filed: Feb. 20, 1986

[51] Int. Cl.[4] ..... G01M 7/00; A63B 69/00; G01D 9/00; G08B 23/00

[52] U.S. Cl. ..... 364/550; 364/508; 272/76; 272/129; 272/DIG. 5; 273/1 GE; 273/DIG. 28; 73/862.27; 73/862.62; 73/379; 340/323 R

[58] Field of Search ..... 364/200, 900, 508, 550, 364/551; 272/76, 98, 129, DIG. 5, DIG. 6, DIG. 9; 273/55 R, DIG. 28, 1 GC, 1 GE; 73/379, 862.27, 862.62; 340/323 R

[56] References Cited

U.S. PATENT DOCUMENTS

| | | | |
|---|---|---|---|
| 3,991,266 | 11/1976 | Baer | 273/DIG. 28 |
| 4,029,315 | 6/1977 | Bon | 273/55 R |
| 4,183,056 | 1/1980 | Evans et al. | 340/323 R X |
| 4,277,828 | 7/1981 | Tateishi | 364/415 |
| 4,337,049 | 6/1982 | Connelly | 273/DIG. 28 |
| 4,358,118 | 11/1982 | Plapp | 273/1 GC |
| 4,367,752 | 1/1983 | Jimenez | 128/689 |
| 4,394,865 | 7/1983 | Sidorenko | 128/782 |
| 4,409,992 | 10/1983 | Sidorenko | 128/782 |
| 4,534,557 | 8/1985 | Bigelow | 273/55 A |
| 4,578,769 | 3/1986 | Frederick | 364/565 |
| 4,647,967 | 3/1987 | Graham, Sr. | 273/55 R |

FOREIGN PATENT DOCUMENTS

| | | | |
|---|---|---|---|
| 2741090 | 3/1979 | Fed. Rep. of Germany | 272/76 |
| 0267403 | 11/1967 | U.S.S.R. . | |

*Primary Examiner*—Parshotam S. Lall
*Assistant Examiner*—Joseph L. Dixon
*Attorney, Agent, or Firm*—Dorr, Carson, Sloan & Peterson

[57] ABSTRACT

An improved reaction time and force feedback system including a first portable housing for placement on the limb of a sporting participant for detecting the time and magnitude of force incurred by the limb during a sporting activity. A second portable housing is located on the body of the participant and receives signals proportional to the magnitude of force and time from the first portable housing in order to transmit the magnitude and time information to a remote location. At the remote location is located a central control which is capable of receiving the transmitted information and displaying that information.

4 Claims, 6 Drawing Sheets

Fig. 6
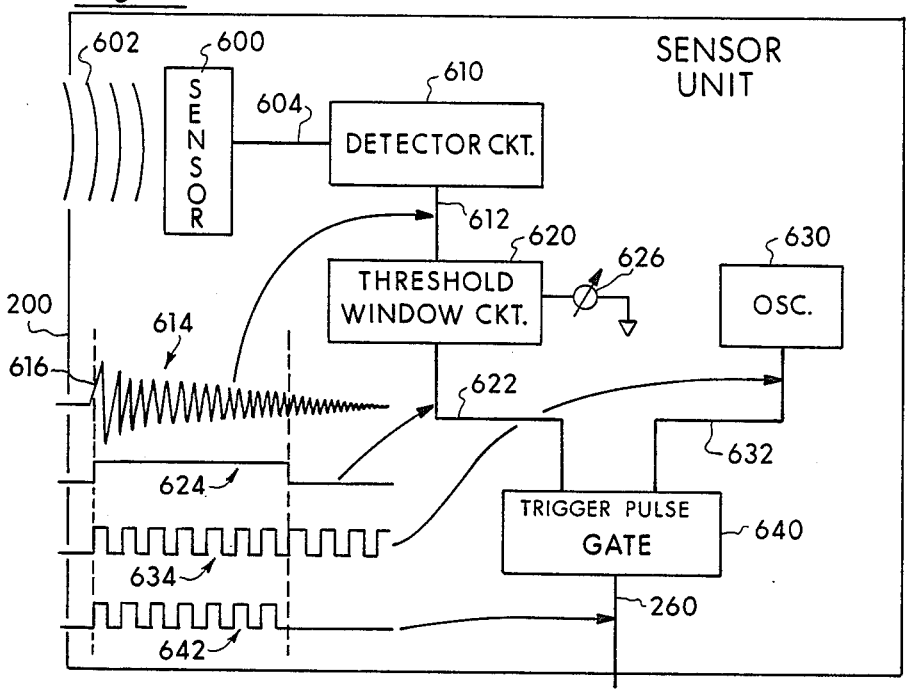
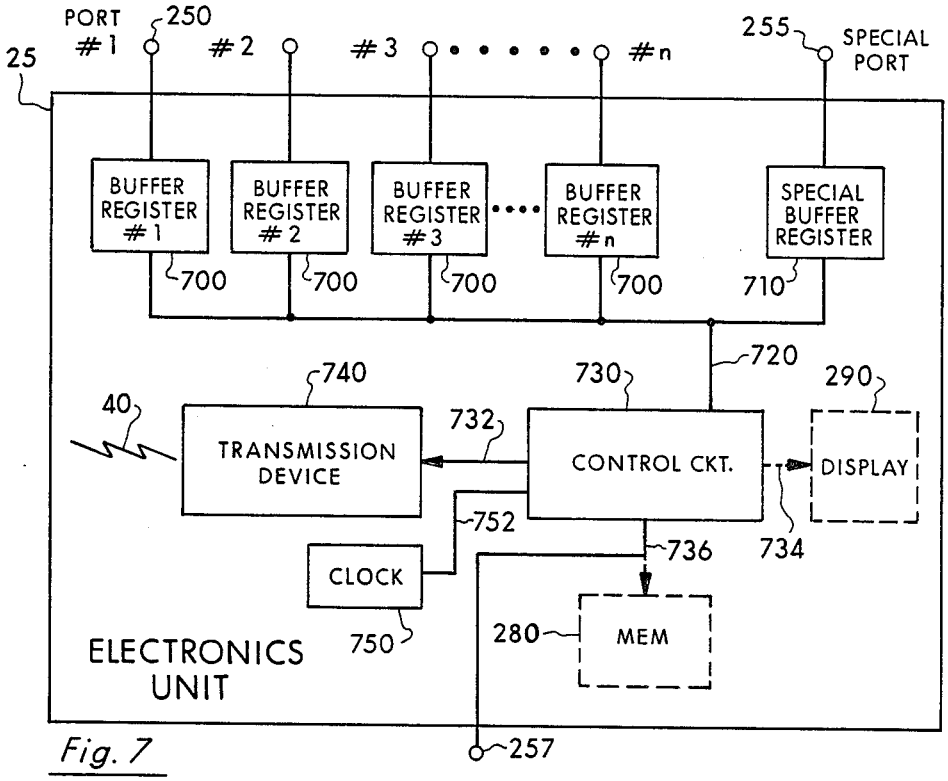
Fig. 7

REACTION TIME AND FORCE FEEDBACK SYSTEM

BACKGROUND OF THE INVENTION

1. Related Inventions

The present invention is related to my following co-pending applications:

(a) Stride Evaluation System, Ser. No. 831,978 and (b) Force Accumulating Device for Sporting Protective Gear, Ser. No. 837,653 filed concurrently with this invention.

2. Field of the Invention

The present invention relates to the field of sports training systems and, more particularly, to an improved sports training device providing reaction time and applied force feedback information produced by sensors located on the body or the equipment of the sporting participant.

3. Discussion of the Prior Art

In my priorly issued patent entitled "Reaction Time and Applied Force Feedback", U.S. Pat. No. 4,534,557, issued on Aug. 13, 1985, a reaction time and applied force feedback system for sports was disclosed wherein force sensitive sensors were placed on or in the physical sporting equipment. Such a system is useful for sensing forces in punching bags, footballs, blocking tackles, and martial arts kicking posts but are limited in their application to use on the actual physical equipment separate from the sporting participant.

My present invention provides a portable reaction time and applied force feedback system actually worn by a sporting participant or incorporated into the equipment worn by a sporting participant in the sporting event or in training for the sporting event.

Prior to the filing of this application, I authorized a patentability investigation for a system that feedbacks reaction time and applied force and which can be worn by the sporting participant. The following patents, in addition to my earlier patent, were uncovered in the search:

| Inventor | Reg. No. | Date |
|---|---|---|
| Bon | 4,029,315 | 6-14-77 |
| Tateishi | 4,277,828 | 7-7-81 |
| Jimenez et al | 4,367,752 | 1-11-83 |
| Sidorenko et al | 4,394,865 | 7-26-83 |
| Sidorenko et al | 4,409,992 | 10-18-83 |

The second patent issued to Sidorenko et al (U.S. Pat. No. 4,409,992) pertains to an electronic ergometer which is placed in the portable housing attached to the waist of a user. The disclosed ergometer converts the oscillations of the body center of gravity into a suitable electrical signal which is then processed. The disclosed ergometer is capable of measuring and registering the work performed by the user and for producing an audible and a visual signal indicating exhaustion of the body's reserve when a predetermined threshold of activity is achieved. The disclosed device provides for constant monitoring of the work performed by the user and is capable of measuring the power developed while walking, running, or jogging. The first Sidorenko et al. patent (U.S. Pat. No. 4,394,865), sets forth an apparatus for determining levels of physical loads also based upon the body center of gravity amplitude of oscillations created by a user. If the amplitude of movements of the user exceeds a certain minimum level, then one indicator is activated. If the amplitude of movements is above a certain optimum level, a second indicator is activated and if the movement is above a maximum level of physical load, a third indicator is activated.

In the 1983 patent issued to Jimenez et al (U.S. Pat. No. 4,367,752) is disclosed a system capable of measuring various parameters such as heart rate and the occurrence of stepping to arrive at a system which is capable of determining the physiological parameters of a runner or jogger.

The 1981 patent issued to Tateishi (U.S. Pat. No. 4,277,828) pertains to an analyzer for determining resulting forces at bone joints. The system is based upon geometric patterns derived from X-ray pictures. The 1977 patent issued to Bon (U.S. Pat. No. 4,029,315) sets forth a target generator for a thrown football in order to measure certain speed parameters.

None of the above approaches disclose an approach for determining the magnitude of force and time thereof delivered by a sporting participant such as delivered by a boxer when punching an opponent or when punching a bag and for displaying this information.

SUMMARY OF THE INVENTION

My present invention sets forth an improved system for displaying the magnitude of forces produced by a sport participant in a sporting event such as boxing, martial arts, track events, swimming events, and the like. The improved system of the present invention includes a first portable housing for placement on a limb, such as an arm or a leg of the participant or in the participant's equipment such as the shoulder pads of a football player. The housing is oriented in close proximity to the extremity of the limb so that it is near the forces produced by that limb. A sensor is located in the housing for detecting the magnitude and relative time of each force produced by the limb. The sensor is firmly oriented on the limb in close proximity to an internal bone structure in order to maximize the detection of the forces. The output of the sensor is a signal proportional to the magnitude of the force produced.

A second portable housing is located elsewhere on the body of the participant such as on a belt around the waist of the participant. The electronics in the second portable housing receives the signal from the sensor, stores that information and transmits it to a remote location.

At the remote location is a central control unit which is capable of receiving the transmitted information and displaying the information. Also at the remote location is video or television equipment which is capable of recording the sporting event and an apparatus for synchronizing the recorded sporting event with the information for each force generated so that the displayed information can be synchronized to show the information while viewing the sporting event or upon playback of the sporting event.

DESCRIPTION OF THE DRAWING

FIG. 6 sets forth the schematic diagram of the sensor unit (measureband) of the present invention;

FIG. 7 sets forth the schematic diagram of the electronic unit of the present invention.

GENERAL DESCRIPTION

Figure 1:
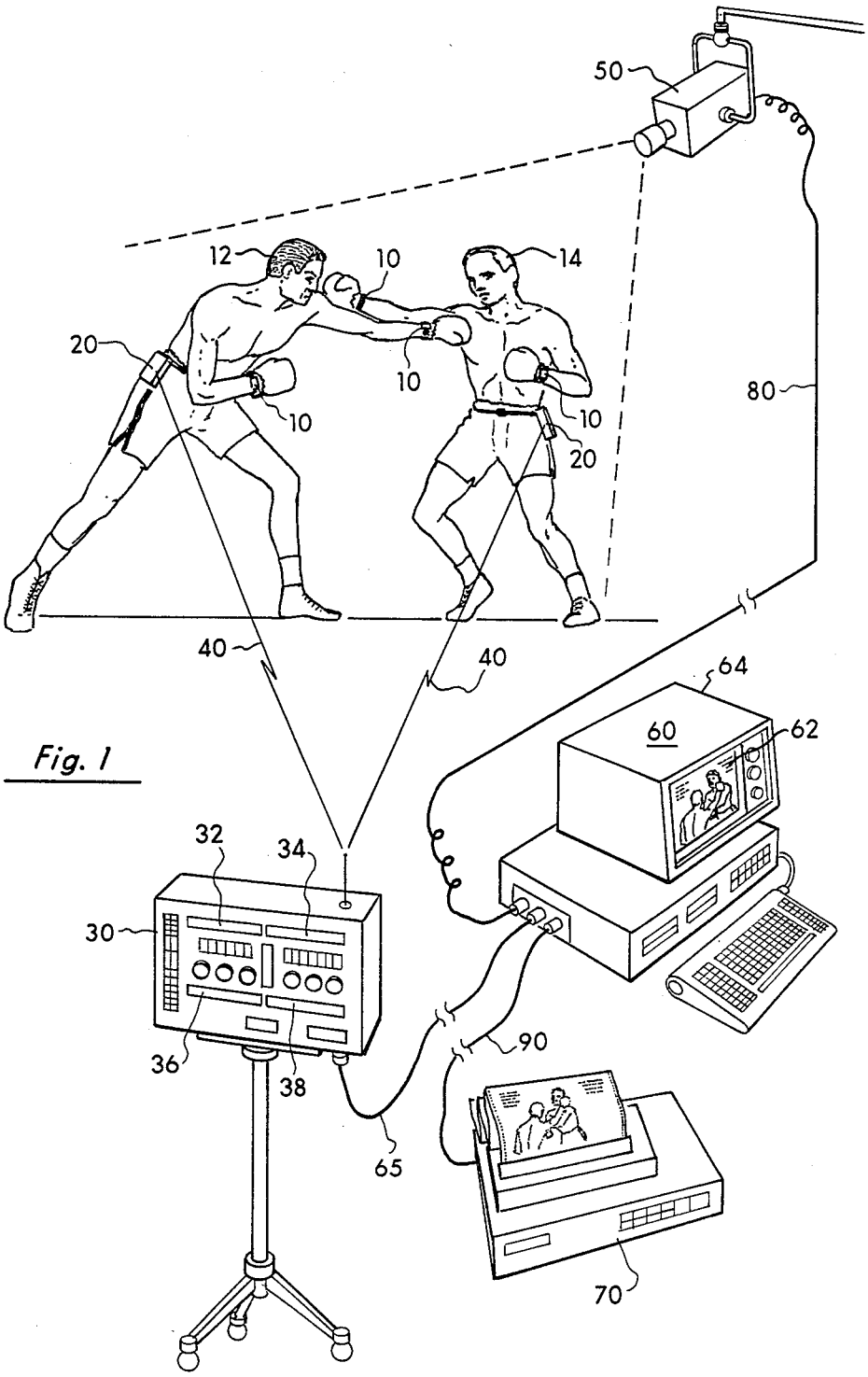
FIG. 1 sets forth an illustration of the system of the present invention being used by two opposing boxers.

In FIG. 1, the measureband 10 of the present invention is shown attached to each wrist of two boxers 12 and 14. Also attached to the waist of each boxer 12 and 14 are the electronic units 20 of the present invention. The electronic units 20 of the present invention, in turn, communicate with a central control 30 via, for example, radio waves 40 of different frequencies. A measureband 10 detects the "shock" or "force" of a given blow. The magnitude of a blow is received by the respective electronic unit 20 and the relative time of the blow is made. The information is then either stored in the electronic unit 20 for subsequent processing, transmitted over radio waves 40 to the central control 30, or both. As will be more fully explained, the system of the present invention does not determine the actual real time (or clock time) of the forces sensed. Rather, a relative time is determined in relation to other sensed forces. In a sense, this is the differential time between sensed forces.

The centralized control 30 at the remote location is capable of displaying the force, the accumulated force of each blow, the relative time of the blows, the time between the blows, the accumulative time, and other related parameters. For example, the following can be determined and displayed at control 30.

Boxer 12:
Last blow=force of 9.78
Time from previous blow=2.375 seconds
Number of blow registered=35
Accumulated force registered=300
Accumulated time=2 min. 52 sec.
Boxer 14:
Last blow=force of 3.92
Time from previous blow=0.427 seconds
Number of blow registered=50
Accumulated force registered=310
Accumulated time=2 min. 52 sec.

As another example, the control 30 can display the accumulated force for the left hand 32 and the right hand 34 of boxer 12 and for the left hand 36 and the right hand 38 of boxer 14.

Hence, under the teachings of the present invention, each measureband 10 is a device which can sense the "shock" resulting from a collision or impact. The electronic unit 20 is capable of storing and/or retransmitting that information including the relative force and time of that collision or impact.

Although a boxing application is shown in FIG. 1, it is to be expressly understood that the present invention finds application in other sporting events such as on the arms and legs of participants in the martial arts for registering blows, strikes and hits. In addition, measurebands 10 could also find application for track events and could be worn on the ankles of the user or for horse training to register the number of strides and the relative pressure of each step as set forth in the above identified co-pending application for "Stride Evaluation System." Likewise, the measureband 10 can be placed in a waterproof container for use by swimmers to register the number of strokes and the relative strength of each stroke.

In FIG. 1 is also shown a video camera 50, a personal computer 60, and a printer 70 interconnected in a system wherein the control 30 is connected to the personal computer 60 over line 65, the video camera is connected to the personal computer over line 80 and the printer is connected to the personal computer over line 90. The system operates as follows. The video camera 50 such as the Model VC-6000, conventionally available from Chorus Data Systems, 6 Continental Boulevard, Merrimack, N.H. records the event in time. Likewise, the measurebands 10 of the present invention, in cooperation with the electronic units 20, transmits over airwaves 40 the magnitude of each punch and the occurrence, in relative time, of that punch. The computer 60 is conventionally a personal computer such as those available from the IBM Corporation and is equipped with a video capture system such as video digitizers and hardware/software packages conventionally available from Chorus Data Systems, 6 Continental Boulevard, Merrimack, N.H. The system freezes the action of the sporting event at the point of where the measureband 10 is providing a sensor signal. This synchronizes the digitized picture 62 of the event at the instant of sensed impact of the blow of a boxer 12 or 14. The value of such registered measureband readings (force, time, accumulated force, etc.) are further processed and displayed along with the digitized picture.

A hard copy of the digitized picture which is displayed on monitor 64 with its synchronized measureband data, may be produced on a printer 70. The same digitized frames of picture and data can also be stored on memory disks for future utilization.

For example, assume boxer 12 makes contact with the left fist as sensed by measureband 10 to boxer 14's body, the value of such event is displayed in readout 32 and, optionally, the action is further digitally displayed on computer monitor 64 along with the precise data relating to such contact. Now if computer 60 is programmed to digitally record images and data at for example every 0.25 seconds from initial contact, for a total of six frames or for a total of one and one-half seconds, the results in playback analysis of that punch would be a complete pictorial account to include the synchronizing of the statistical values thereto, e.g., Frame #1 shows initial contact=image depicts boxer 12's body form and contact force of 5.382, Frame #3 shows pick contact=image depicts boxer 12's body form and contact force of 9.501, and Frame #6 shows end contact=image depicts boxer 12's body form and contact force of 3.332. Hence, the complete follow through of the punch can be scrutinized on a force-visual analysis. It is important to understand that the devices 60, 50, and 70 are all options to augment the training of such athletes as boxers 12 and 14. The central control/display 30 is adequate for monitoring a training event.

Figure 5:
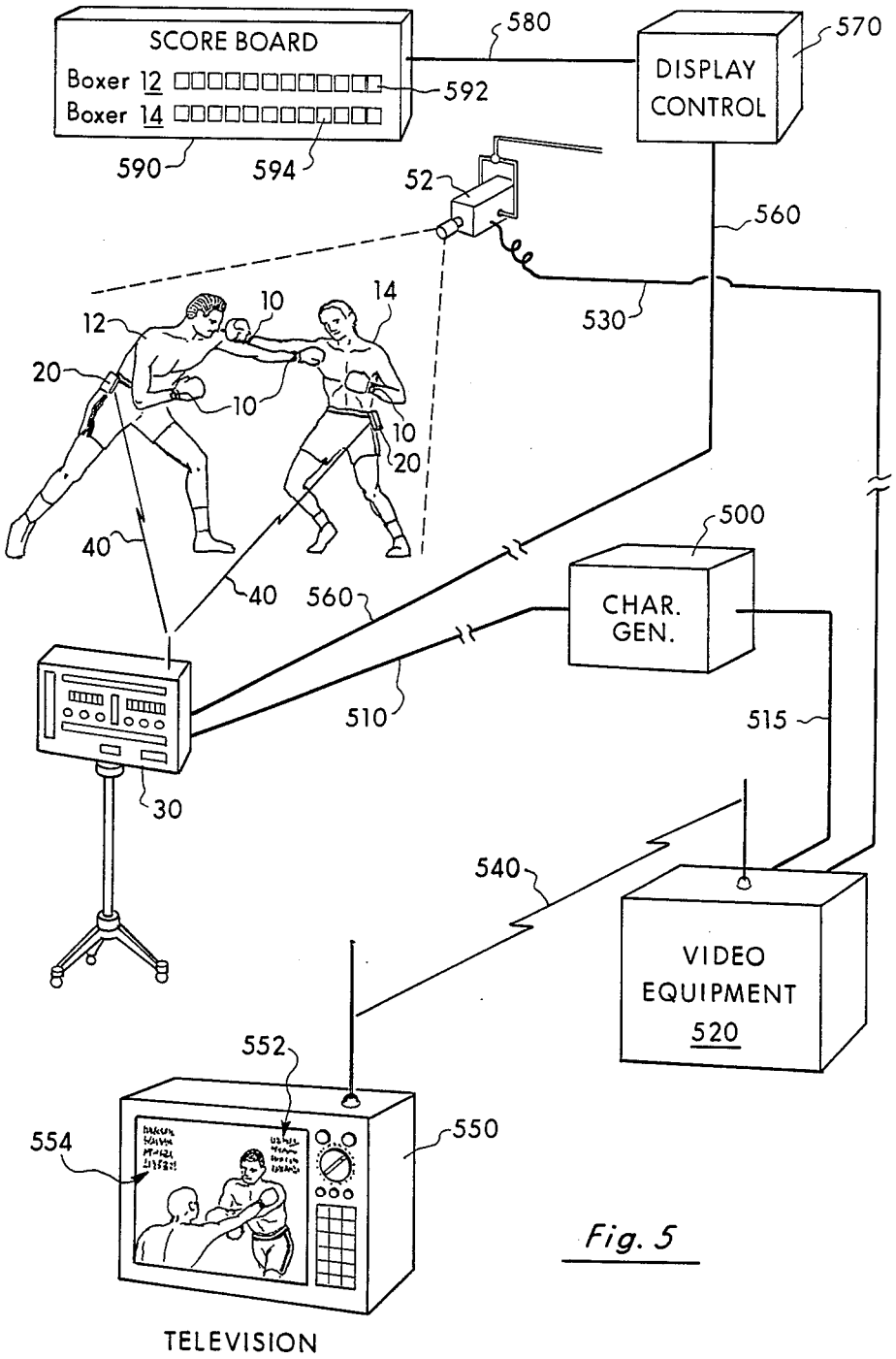
FIG. 5 sets forth an illustration of a second embodiment of the system of the present invention similar to that of FIG. 1.

FIG. 5, as will be further explained, depicts a commercial application which affords observers and viewers a dynamic account of sporting events with respect to values of for example punches by boxers. The system of the present invention (whether it be applied to boxing, track, or swimming events) provides useful information to trainers, coaches, and athletes. This is particularly true in the field of boxing, for example, the force of each blow, the time between blows, the accumulated force in each round, the number of blows accumulated in each round, the accumulated force in each bout, and the number of blows accumulated in a bout.

Figure 2:
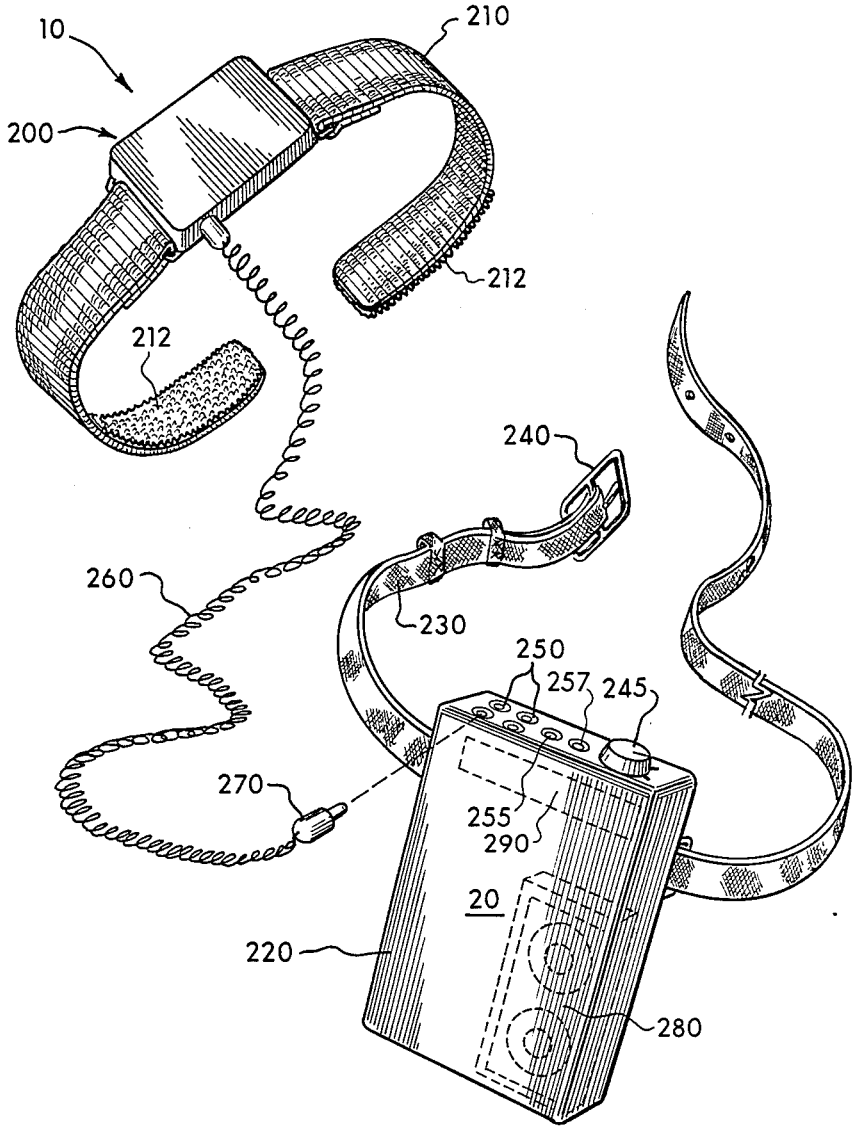
FIG. 2 sets forth a perspective illustration of the measure band unit and the electronics unit of the present invention.

In FIG. 2, the details of the measureband 10 and electronic unit 20 are set forth. The measureband 10 includes an electronic sensor mounted in a housing 200 which is attached to a band 210 having a suitable connector such as VELCRO brand fastening material 212. The electronic unit 20 is contained within a housing 220 suitably connected to a waist or chest belt 230 having a conventional connecting means 240 for holding the belt 230 on the waist or chest of the user. The measureband 10 is self-powered, not shown. The electronic unit contains an on-off switch 245 and a series of input plugs 250, a special input 255 for connecting to a heart sensor or the like, and a memory read output 257.

In one preferred embodiment, a hard wire interconnection 260 electrically connects the measureband 10 with the electronic unit 20. The wire link 260, for example, has a jack 270 which inputs into one of the plugs 250. It is to be expressly understood that the hard wire link 260 in other preferred embodiments could be conventionally replaced with an infrared link, a radio link or a combination thereof. The measureband 10 can be easily attached to the body part of interest (i.e., the wrist for boxing or the ankle for track events) or to the sporting equipment such as shoulder pads. The electronic unit 20 is self-powered with a conventional internal battery, not shown.

Optionally, the electronics unit 20 can incorporate a local display 290 and a miniature magnetic tape cassette 280 for recording the event.

The system control 30 of the present invention, as mentioned, could be the system described in my earlier issued U.S. Pat. No. 4,534,557 suitably interfaced to receive the transmitted information from the electronic unit 20.

Figure 3:
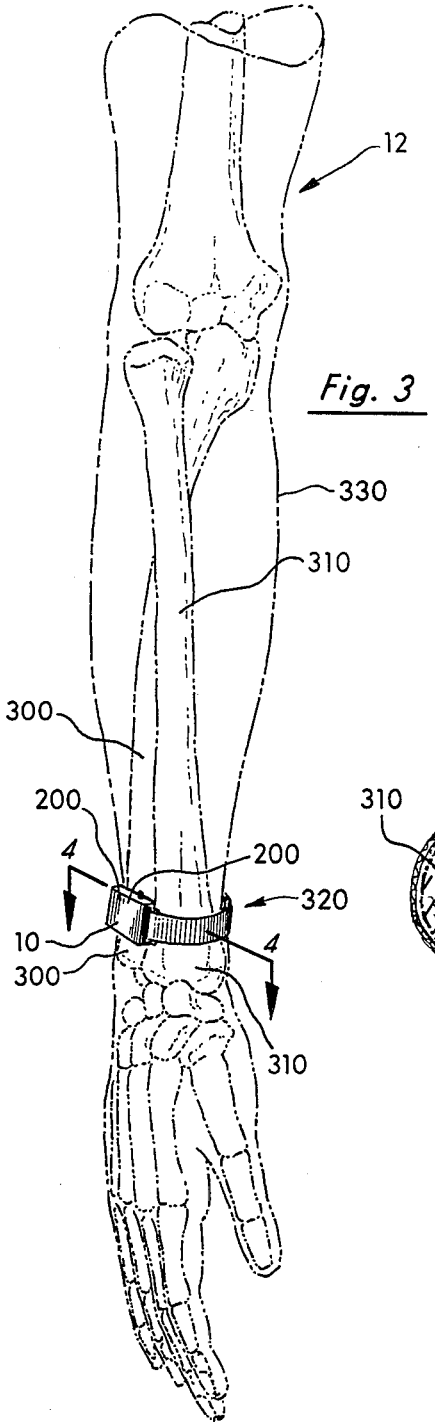
FIG. 3 sets forth a perspective illustration of the placement of the measure band of the present invention around the wrist of a user.
Figure 4:
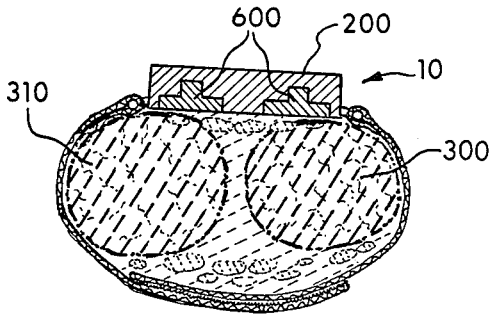
FIG. 4 sets forth in cross-section, the orientation of the sensor of the present invention in relation to the internal bone structure of the user.

In FIGS. 3 and 4, the measureband 10 is designed so that the housing 200 is located at the extremity 320 of the limb 330 of a user 12 and so that the sensors 600 abut in close proximity to an internal bone structure such as the ulna bone 300 or the radial bone 310.

As will be more fully discussed, the sensor pad 600 is designed to come as close in contact with the internal bone structure (300, 310) of the user as is possible. Hence, when strapped to the ankle, the measureband 10 should be in close proximity to the ankle or shin bones. By maintaining the closest possible contact with the bone structure 300, the maximum shock or force pickup due to a given blow is achieved by the sensors 600 of the present invention. In the case of use on equipment such as shoulder pads or the like, the sensor 10 would be placed on the equipment in accordance with the teachings of my earlier invention, U.S. Pat. No. 4,534,557.

In FIG. 5, yet another arrangement similar to that shown in FIG. 1 is set forth. In this arrangement, the central control 30 is interconnected to a conventional character generator 500 over line 510 and then over line 515 to conventional video equipment 520. Likewise, the video camera 52 is connected over line 530 to the standard video equipment. The video equipment 520 issues a transmission over conventional medium 540 which is subsequently received over a home television 550. In addition, the central control 30 is interconnected over line 560 to a display control 570 which is interconnected over line 580 to a display 590. In this system, the real time measurement of each blow to each boxer 12 and 14 is displayed 594 at the boxing arena under the control of the display control 570.

The scoreboard displays the last values sensed as well as the accumulated forces, etc. No synchronization is not necessary as found in FIG. 1 becuase it is witnessed live, e.g., boxer 12 hits boxer 14. The observer then looks at the scoreboard to see the stats. Likewise, that information is delivered to the conventional video equipment 520 for display 552 and 554 of the actual force of the blow and the timing of the blow for each boxer. Display control 570 scoreboard 590 may be any of those which are conventionally available through many manufacturers, such as Colorado Time Systems, Inc., 300 S. Taft Avenue, Loveland, Colo. The Colorado Time Systems, Inc. "Aquatics" series is well suited for this purpose.

DETAIL DESCRIPTION OF THE INVENTION

In FIG. 6, the block diagram schematic for the sensor unit 10 is shown to include a sensor 600 sensitive to vibrations, a detector circuit 610, a threshold window circuit 620, an oscillator 630, and a gate circuit 640. The sensor 600 is sensitive to vibration 602 caused by the force of the shock and generates an analog voltage signal on line 604 which is connected to the detector circuit 610. The output of the detector circuit 610 is delivered on line 612 into the threshold window circuit 620. The character of the signal on line 612 is shown as curve 614. The output of the threshold window circuit 620 is binary and is delivered on line 622 as a signal shown by curve 624. The oscillator 630 is interconnected to the gate circuit over line 632 and delivers a clock signal of known frequency such as shown as curve 634. In the gate circuit 640, the threshold window signal 624 acts as a trigger to allow the passage of the clock pulses 634 onto line 260 which is delivered to the control electronics 20 as curve 642. Hence, the number of pulses in curve 642 is proportional to the duration of the vibrations which in turn is proportional to the strength or value of the force detected. In other words, the greater the number of pulses in curve 642, the stronger the force delivered by the boxer or the force delivered in another sporting activity.

The sensor 600 can be comprised of a conventional pressure transducer/strain gauge circuit as shown in FIGS. 2 and 3 of my earlier U.S. Pat. No. 4,534,557. Such a sensor measures both tensional and compressional forces. The detector circuit 610 amplifies the signal from the sensor 600 and as shown by curve 614, the signal is an analog "ringing" signal that exponentially decays down to a barely discernible signal. The detector circuit 610 is conventional, e.g., an amplifier manufactured by Radio Corporation America (RCA), Harrison, N.J. 07029 as Model CA3010 and wired as a detector.

The threshold window circuit 620 is also conventional and is the amplifier manufactured by RCA as Model CA3010 and wired as a threshold level device. The threshold window circuit 620 provides a window as shown by curve 624 only when the signal 614 is above a threshold value. The signal below the threshold value is not processed.

The oscillator 630 is of a conventional design and is available from Signetics Corporation, 811 East Arques Avenue, Sunnyvale, Calif. 94036, as Model NE555. The preferred frequency of the oscillator 630 is ten kilohertz.

In operation, the housing 200 as shown in FIGS. 3 and 4 is oriented in close proximity to the extremity of the limb near the location of the force generated by the limb (e.g., the hand of FIG. 3). The sensor 600 is firmly oriented on the outer surface of the limb in close proximity to the internal bone structure of the limb in order to maximize the detection of the forces generated by the limb. The orientations of the housing 200 and sensor 600 also serve to minimize receipt of signals corresponding to forces received by a sport participant (e.g., blows delivered to the body of a boxer by an opponent). In addition, proper adjustment of the threshold window circuit 620 through manual adjustment of control 626 can be made to raise the threshold 616 thereby eliminating background forces delivered to the participant or created by the participant (i.e., other forces such as a blow delivered by the hand other than the hand being sensed). In other words, the orientation of the sensor 600 and the proper adjustment of the threshold circuit 620 serves to sense only the forces delivered by that particular limb of a participant while achieving maximum sensitivity.

In FIG. 7, the details of the electronics 25 contained in housing 20 is set forth to include a plurality of buffer registers 700 and a special buffer register 710. The buffer registers 700 and the special buffer register 710 are interconnected over bus 720 to a control circuit 730. The control circuit 730, in turn, is connected over line 732 to a transmission device 740, a display 290 over line 734, a clock 750 over line 752 and a memory 280 over line 736. The first buffer register 700 receives the signal over line 260 from the sensor unit 200. The buffer register 700 is conventional and is comprised of an RCA device such as Model CD-4020B. This 14-stage binary ripple counter is conventionally wired so as to register the number of pulses present on line 260 as signal 642.

The remaining buffer registers 700 are capable of providing other force inputs from other measurebands such as, connected to the other wrist, or from the ankles. The special buffer register 710 is able to receive an input pertaining to heart rate, body temperature, or the like.

The control circuit 730 is conventional and is comprised of a circuit capable of multiplexing the several "buffer registers" and coding the data as to where the data is from, i.e., which buffer register 700 and for assigning the relative time information from clock 750. Further, it forwards the coded data to the optional devices 280 and 290 and/or to the transmission device 740, for transmission in appropriate signal form.

The transmission device 740 can be in a number of configurations all of which are conventional and can be a driver for a wire; an infrared transmitter; or a radio transmitter transmitting a radio wave 40. For example, such a radio device may be manufactured by RCA as Model CA-3000. An amplifier with an appropriate antenna with less than 100 MW output power is adequate to support the short range between the electronics unit 20 and the central control 30. The transmitter 740 is preferably of the frequency shift keying type and should operate in the appropriate band for such applications. This most conventional carrier wave radio-frequency technique will be utilized in a number of frequencies, e.g., 72.2 megahertz for electronics unit 20 of boxer 12 and 72.4 megahertz for electronics unit 20 of boxer 14, etc.

The optional memory 280 is also conventional and may comprise an electronic memory or magnetic tape such as a "miniature tape transport" wired conventionally for such data recording/playback which is available conventionally by Sony Corporation among others. Or, in the "electronic memory" version, Intel Corporation's Model 5101 static random-access memory integrated circuit, wired conventionally to store information in the "WRITE" mode, and playback information which was stored in the "READ" mode.

The optional display 290 is conventional with the present invention and is a conventionally available liquid crystal display, for example, the type manufactured by Hamlin Corporation, Lake & Crove Streets, Lake Mills, Wis. as Model #4216 which is conventionally wired to indicate the value of each data as then present in each register or "playback" with optional memory circuit.

In operation, the electronic unit 20 as shown in FIG. 7 is capable of receiving a number of inputs from different sensors 200. For example, and as shown in FIG. 2, two sensor units 200 can be connected to the wrists of a user as well as having two connected to the ankles of that user for a total of four inputs to buffer register 700. The signals are then delivered over a bus 720 to a control circuit 730 for processing. Hence, the magnitude and duration of each force can be recorded by the control circuit 730 in memory 280, displayed through display 290 or transmitted over the transmission device 740 to a remote control unit 30.

Figure 8:
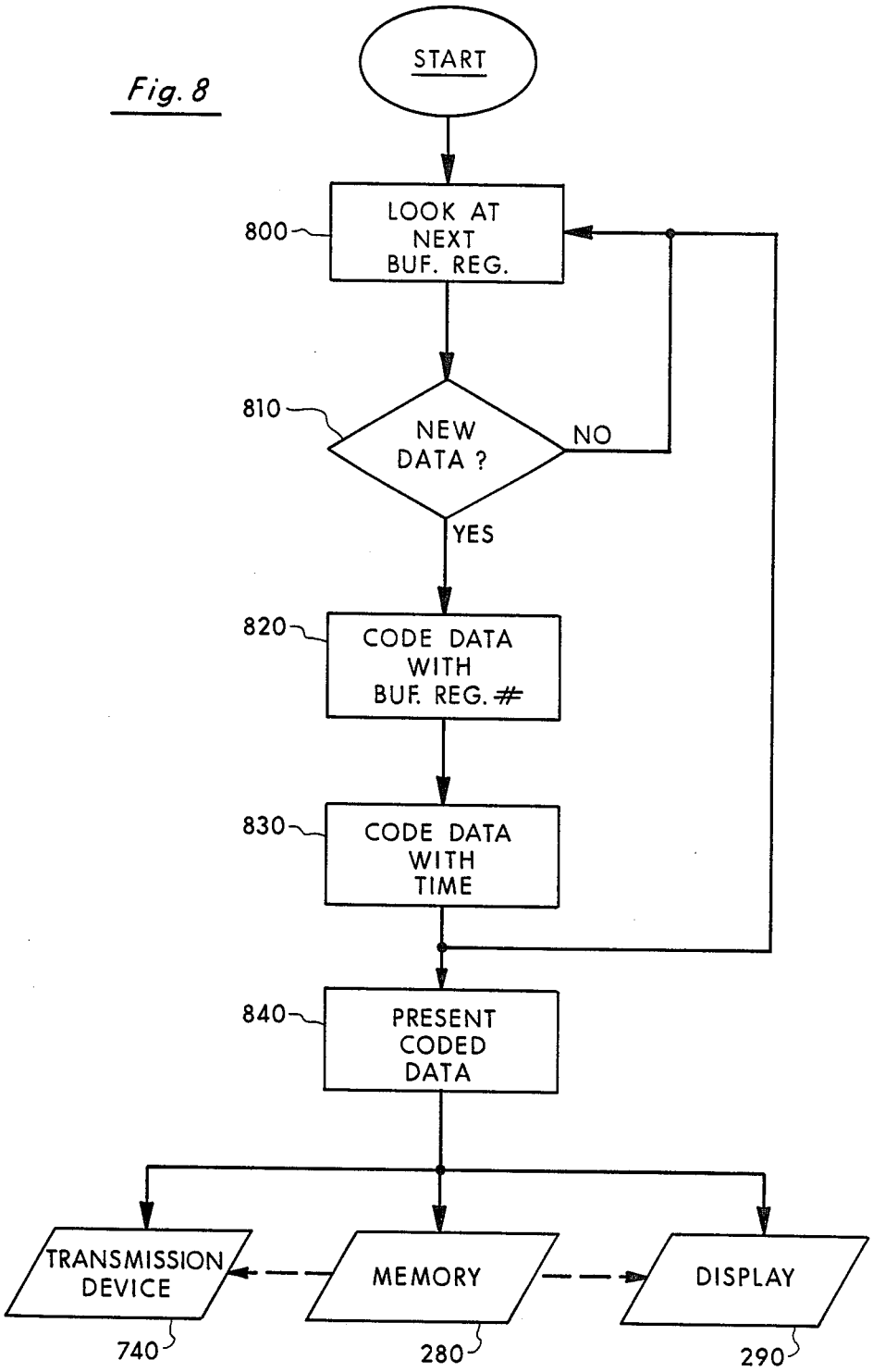
FIG. 8 sets forth the flow diagrams for the control circuit of the present invention shown in FIG. 7.

In FIG. 8, the flow chart for the operation of the control circuit 730 is set forth. The control circuit 730 interrogates the status of the next buffer register 700 at stage 800. A determination is made at stage 810 as to whether or not new data is present. If no new data is present, the control circuit 730 goes to the next buffer register 700. If data is present, stage 820 is entered wherein the control circuit 730 codes the data present in the buffer register 700 with the buffer register number. In stage 830 the data is further coded with the time. Upon completion of stage 830, the control circuit 730 seeks the next buffer register 700. In this fashion, the control circuit 730 interrogates each buffer register 700 including the special buffer register 710 and codes the information with the buffer register identity and the time. Upon completion, the control circuit 730 then presents the coded data in stage 840 for delivery to the transmission device 740 to the optional memory 280 or to the optional display 290.

It is to be noted that while individual components have been set forth and discussed for the sensor unit 200 and the electronics unit 25, each unit, in the preferred embodiment, will be microminiaturized onto a single chip.

While preferred embodiments of the present invention have been shown, it is to be expressly understood that modifications and changes may be made thereto and that the present invention is set forth in the following claims.

I claim:

1. An improved system for displaying the actual magnitude of forces produced by the limbs of a sport participant in a sporting event, said system comprising:

a first portable housing (10) for placement on at least one limb of said participant, means (200) in said first portable housing for sensing the magnitude of each said force produced by said limb, means firmly engaging around said limb and connected to said first portable housing for holding said sensing means firmly against the outer surface of said limb in close proximity to the internal bone structure of said limb such as the wrist or ankle in order to maximize the detection of said magnitude of said forces so that said sensed magnitude of said forces corresponds to said actual magnitude of said forces, said sensing means also generating a digital signal (642) proportional to the magnitude of each said force, a second protable housing (20) for placement on the body of said participant remote from said first portable housing, means (25) in said second portable housing receptive of said digital magnitude signal from said sensing means for storing information corresponding to (a) said actual magnitude of said force, (b) the relative time of each sensed force, and (c) the differential time between occurrences of each said sensed force signal, said receiving means also transmitting said magnitude and differential time information (40) to a remote location, and means (30) at said remote location for receiving said transmitted magnitude and time information from said storing means, said receiving means also displaying said information.

2. The improved system of claim 1 in which said sensing means further comprises:

means (600, 610) for detecting force (602), said detecting means also issuing an analog signal (614) proportional to said magnitude of said force, means (620) receptive of said analog signal from said detecting means for producing a window signal (624) only when the analog signal (614) is greater than a predetermined value, and means (630, 640) receptive of said window signal from said producing means for generating said digital signal (642).

3. An improved system for displaying the magnitude of forces produced by a sport participant in a sporting event, said system comprising:

means (50) for visually recording said sporting event, a first portable housing (10) for placement on at least one limb of said participant, said portable housing being oriented in close proximity to the extremity of said limb near the forces produced by said limb, means (200) in said first protable housing for sensing the magnitude of each said force produced by said limb, means firmly engaging around said limb and connected to said first portable housing for holding said sensing means being firmly oriented on the outer surface of said limb in order to maximize the detection of said forces so that said sensed magnitude of said forces corresponds to said actual magnitude of said force, said sensing means also generating a digital signal (642) proportional to the magnitude of each said force, a second portable housing (20) for placement on the body of said participant, means (25) in said second portable housing receptive of said digital magnitude signal from said sensing means for receiving information corresponding to (a) said actual magnitude of said force, (b) the relative time of each sensed force, and (c) the differential time between occurrences of each said force signal, said receiving means also transmitting said magnitude and time information (40) to a remote location, means (30) at said remote location for receiving said transmitted magnitude and time information from said receiving means, and means (60) connected to said receiving means (30) and to said video recording means (50) for synchronizing, in time, the visual recording to the occurrence of each force by the sport participant so that the forces are displayed on said visual recording of the sporting event on a monitor (64) at substantially the time of the occurrence of each said force.

4. An improved system for displaying the magnitude of forces produced by a sport participant in a sporting event, said system comprising:

means (520) for televising said sporting event, a first portable housing (10) for placement on at least one limb of said participant, said portable housing being oriented in close proximity to the extremity of said limb near the forces produced by said limb, means (200) in said first portable housing for sensing the magnitude of each said force produced by said limb, means firmly engaging around said limb and connected to said first portable housing for holding said sensing means being firmly oriented on the outer surface of said limb in order to maximize the detection of said forces so that said sensed magnitude of said forces corresponds to said actual magnitude of said force, said sensing means also generating a digital signal (642) proportional to the magnitude of each said force, a second portable housing (20) for placement on the body of said participant, means (25) in said second portable housing receptive of said digital magnitude signal from said sensing means for receiving information corresponding to (a) said actual magnitude of said force, (b) the relative time of each sensed force, and (c) the differential time between occurrences of each said force signal, said receiving means also transmitting said magnitude and time information (40) to a remote location, means (30) at said remote location for receiving said transmitted magnitude and time information from said receiving means, and means (500) connected to said receiving means (30) and to said televising means (520) for synchronizing, in time, said televised sporting event to the occurrence of each force generated by the sport participant so that the forces are displayed with said televised sporting event at substantially the time of the occurrence of each said force.

* * * * *